United States Patent [19]

Kandybowski et al.

[11] Patent Number: 4,536,055

[45] Date of Patent: Aug. 20, 1985

[54] STAMPED AND FORMED STACKING DEVICE FOR CIRCUIT BOARDS AND A METHOD FOR MAKING

[75] Inventors: Steven J. Kandybowski, Tower City; Matthew M. Sucheski, Harrisburg, both of Pa.

[73] Assignee: AMP Incorporated, Harrisburg, Pa.

[21] Appl. No.: 543,554

[22] Filed: Oct. 19, 1983

[51] Int. Cl.[3] ..... H01R 11/22; H01R 43/00

[52] U.S. Cl. ..... 339/258 R; 29/874; 339/17 C; 339/221 R

[58] Field of Search ..... 29/874, 882; 339/17 C, 339/17 CF, 17 L, 220 R, 221 R, 221 M, 258 R, 258 P; 361/393, 412, 413

[56] References Cited

U.S. PATENT DOCUMENTS

| | | | |
|---|---|---|---|
| 3,142,891 | 8/1964 | Travis | 29/874 X |
| 3,696,323 | 10/1972 | Kinkaid et al. | 339/221 M X |
| 3,850,500 | 11/1974 | Cobaugh et al. | 339/17 C X |
| 4,362,353 | 12/1982 | Cobaugh et al. | 339/258 P |

*Primary Examiner*—Howard N. Goldberg
*Assistant Examiner*—Carl J. Arbes
*Attorney, Agent, or Firm*—Allan B. Osborne

[57] ABSTRACT

The invention disclosed relates to a device for stacking, securing and spacing printed circuit boards, one on top of another. More particularly, the device is stamped and formed from coplanar stock and includes a reverse bend upper end which provides a receptacle for receiving the lower end of a device mounted in an overlying board or a lead from an electronic device, a lower end and an intermediate section for retaining the device in the board or in dielectric body.

4 Claims, 7 Drawing Figures

STAMPED AND FORMED STACKING DEVICE FOR CIRCUIT BOARDS AND A METHOD FOR MAKING

BACKGROUND OF THE INVENTION

1. Field of the Invention

The present invention relates to devices for stacking, securing and spacing circuit boards one on top of another. Further, the device of the present invention is stamped and formed from coplanar stock.

2. Prior Art

The invention disclosed herein is a novel improvement and significant departure from at least the following:

| U.S. Pat. No. | Patentee | Class/Subclass |
|---|---|---|
| 2,855,206 | Haviland | 279/1 |
| 3,836,703 | Coules | 174/138 D |
| 3,880,486 | Avakian | 339/17 M |

Haviland and Coules disclose stacking devices having receptacle means on the upper end and a lower end which either locks onto the underside of the circuit board or is lockingly received in the receptacle means. Haviland's device is an elongated cylinder with a socket in the upper end and a plug-like lower end which includes a conical surface diverging upwardly to form shoulders. The socket, with a like shape, conformably receives the lower end.

Coules' device includes a rectangular upper frame structure with an opening through the top wall and a flexibe locking member integral with and depending from the bottom wall. The locking member has reverse extending fingers which catch on the underside of a board or beneath the top wall when the member is inserted into the frame structure on a like device mounted on an underlying board. Coules' device is not designed to accept leads or pins from electronic devices.

Avakian's device is not a stacking device per se: rather it is an electrical interconnect device between boards, being made from a resilient conductive material. The device includes a circular head portion at the upper end, a plug portion with upwardly extending, converging surfaces at the lower end and an interconnecting shank. The converging surfaces on the plug portion and downwardly facing shoulders on the head portion cooperate to removably secure the device to a board. On stacked boards with devices in registration, the plug portion of one device is received in a V-shaped groove cutting across the head portion of a like device on an underlying board. In an alternative embodiment, a recess or aperture extends into the device from the head portion. This aperture receives a lead or pin from an electronic device to electrically connect it to the board.

SUMMARY OF THE INVENTION

The present invention is a device for stacking printed circuit boards one above the other and for carrying current from board to board. The device may be stamped and formed from a coplanar, conductive material. In the alternative, the device may be molded using a relatively stiff non-conductive material. The device includes a leg-receiving receptacle which is formed by folding the upper end back on itself and providing an opening therethrough. An intermediate section may include compliant beams which frictionally engage the wall of the hole in the board on which the device is mounted. The lower end of the device is a leg which extends below the board for insertion into the receptacle of a like device mounted on an underlying board.

DESCRIPTION OF THE PRESENT INVENTION

Figure 1:
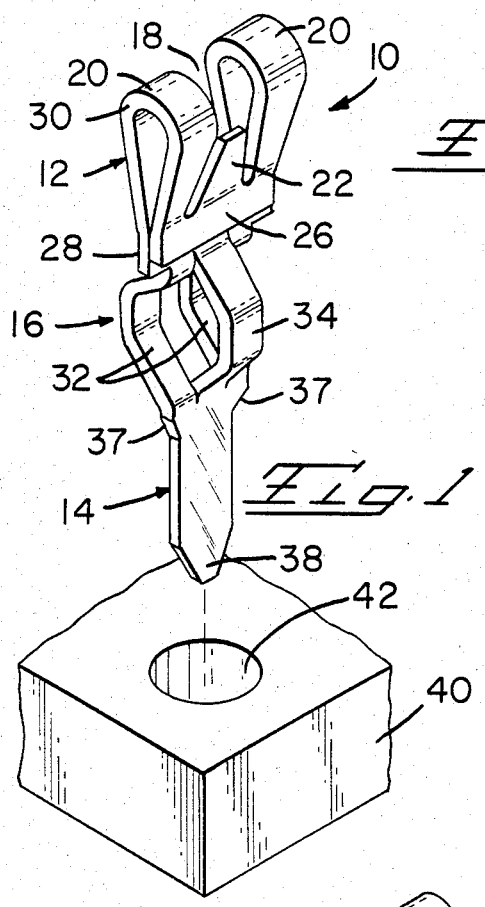
FIG. 1 is an isometric view of the device constructed in accordance with the present invention.

FIG. 1 shows device 10 of the present invention which was stamped and formed, preferably in continuous strip, from coplanar, conductive material. One such material would be a copper alloy with a tin lead plating. However, the device could also be formed from rigid, non-conductive material if desired. The device includes three sections: an upper section or receptacle 12, a lower section or leg 14 and an intermediate section 16.

Receptacle 12 includes an opening 18 defined by spaced apart side members 20 and two first tabs 22, only one of which can be seen in FIG. 1. The receptacle is formed from an elongated, coplanar strip 24 shown in FIG. 7 to which attention is now drawn. Material is removed from the center of the strip such as to provide opening 18 and with first tabs 22 projecting thereinto. One tab is attached to cross-member 26, which is also the free end of the strip, and the other tab is attached to cross member 28 which is the top portion of intermediate section 16 as well as the lower portion of the receptacle. The strip is reversely bent in a manner to form a U-shape with the cross member 26 meeting cross-member 28 and with the bend area curving around as indicated by reference numeral 30 in FIG. 1.

Intermediate section 16 is preferably a three beam compliant member adapted for being inserted into a circuit board hole and being retained therein frictionally. Two beams, indicated by reference numeral 32, are bent so as to extend laterally in one direction while the third beam 34, bracketed by the other beams, extends laterally in the opposite direction. The lines 36, shown on the blank in FIG. 7, indicate where the section is slit to provide the segments which will form the beams. The lower portion of the intermediate section narrows into its junction with leg 14 to define downward facing beveled shoulders 37.

Leg 14, connected to and extending downwardly from the intermediate section, is preferably beveled at its free end or tip 38.

Figure 2:
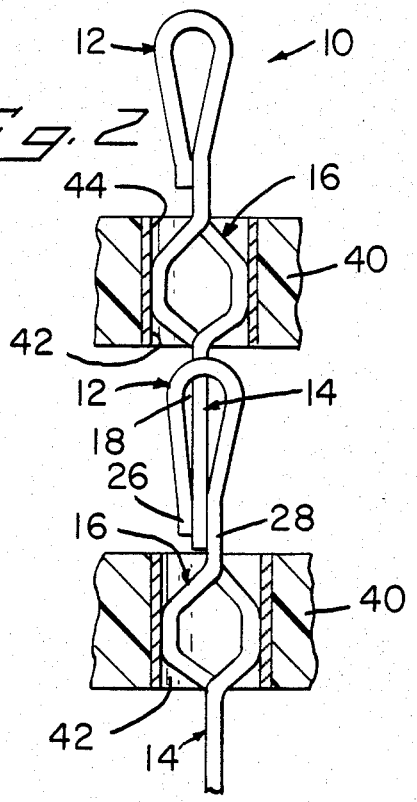
FIG. 2 is a view, partly sectioned, showing devices of FIG. 1 in use stacking and electrically interconnecting circuit boards.

FIG. 1 also includes a portion of a circuit board 40 through which hole 42 extends. It is in such a board that device 10 is utilized as shown in FIG. 2. Two such boards are shown therein stacked, one over the other. Devices 10 have been positioned on the boards so that receptacles 12 extend above the respective board and legs 14 extend below. The intermediate sections are frictionally fit in holes 42 to securely mount the devices to the boards. The beams further are in electrical contact with conductive material 44 which plates the wall of the holes and is connected to traces (not shown) on and in (e.g. a multi-layer) the boards. The leg of the overlying board has been inserted into receptacle 12 of the device mounted in the lower board. The leg had entered opening 18 and in between the two cross members, 26 and 28 spreading them in so doing. The resilient separating provides a compressive force against the leg for good mechanical retention and electrical contact. Leg insertion into the receptacle is limited by beveled shoulders 37 landing on side members 20.

Tabs 22 provide a lead in to guide leg 14 in between the two cross members 26 and 28. This is to accommodate misalignment of leg 14.

Figure 3:
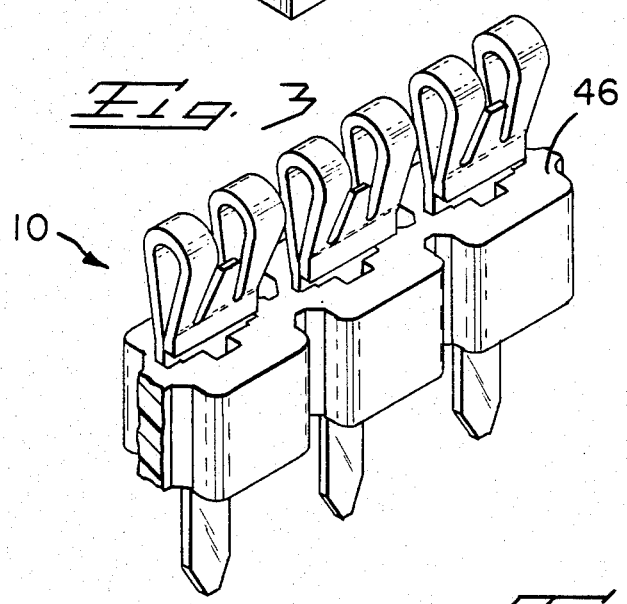
FIG. 3 is an isometric view showing three devices of FIG. 1 with the intermediate sections encased in a dielectric strip.
Figure 4:
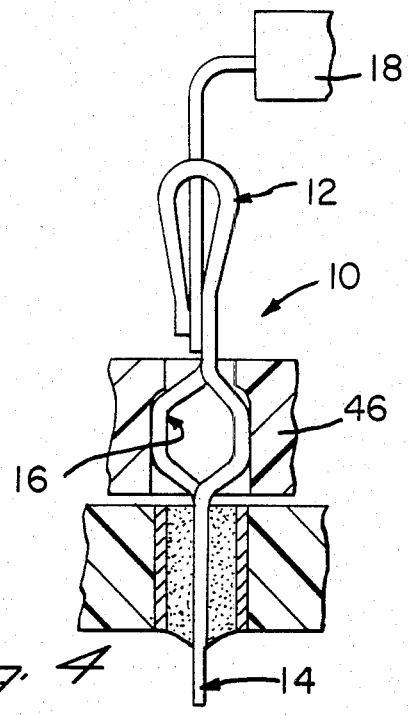
FIG. 4 is a view, partly sectioned, of one device of FIG. 3, mounted in a board and with a lead from an electronic device plugged into it.

FIG. 3 is a drawing showing a strip of devices 10 with the intermediate sections 16 encapsulated by a dielectric body 46 such as thermo plastic. FIG. 4 shows one such device, broken away from the others, being used as a contact element connecting an electrical component 48, e.g. a resistor, to the board. In this utilization, leg 14 has been soldered into hole 42. In this regard, the device 10, sans dielectric body 46, could have been mounted in the board as shown in FIG. 2 and still receive the lead from the electrical component.

In the FIG. 4 use, the device is permanently fixed and the intermediate section extending above the board is insulated against inadvertent electrical contact.

Figure 5:
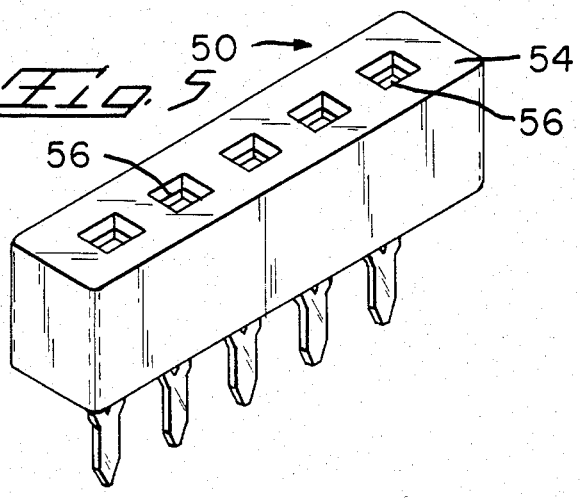
FIG. 5 is an isometric view showing an alternative embodiment to the device of FIG. 1 and a housing provided therefore.
Figure 6:
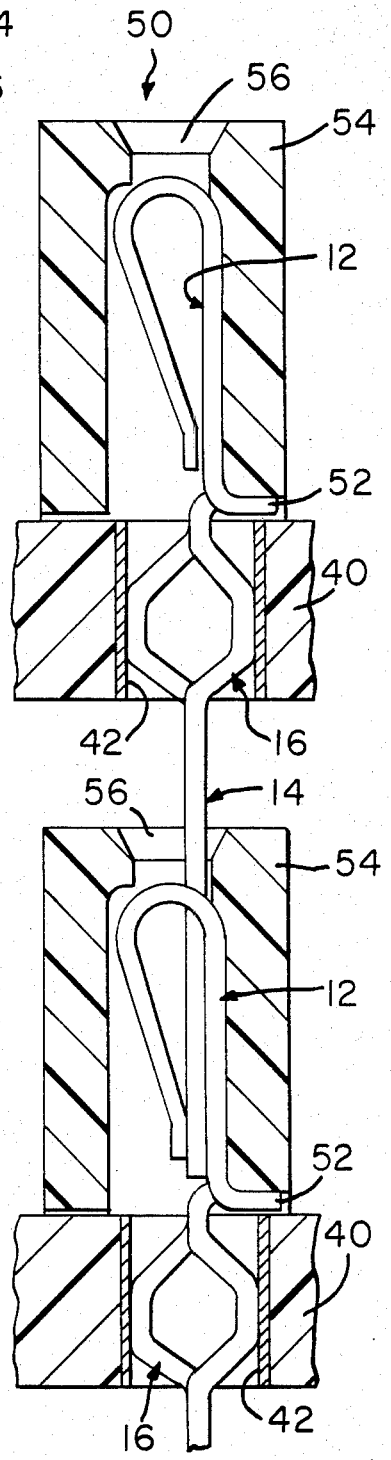
FIG. 6 is a sectional view of the embodiment of FIG. 5 in use.

FIG. 5 shows another embodiment and utilization of the device of the present invention. This embodiment has a pair of second tabs 52 which are shown in FIG. 6 and in dashed lines in FIG. 7. Further, a housing 54 has been provided which slides down over receptacle 12 and is supported thereon by second tabs 52. Openings 56 in the housings provide access to the receptacle as shown in FIG. 6. Two such devices are shown mounted on boards with intermediate sections 16 in the holes 42. Tabs 52 are shown above the surface above the surface of the boards but the devices could have been inserted to where the tabs encounter the surface. Leg 14 of the overlying device has been inserted into receptacle 12 through opening 56.

Figure 7:
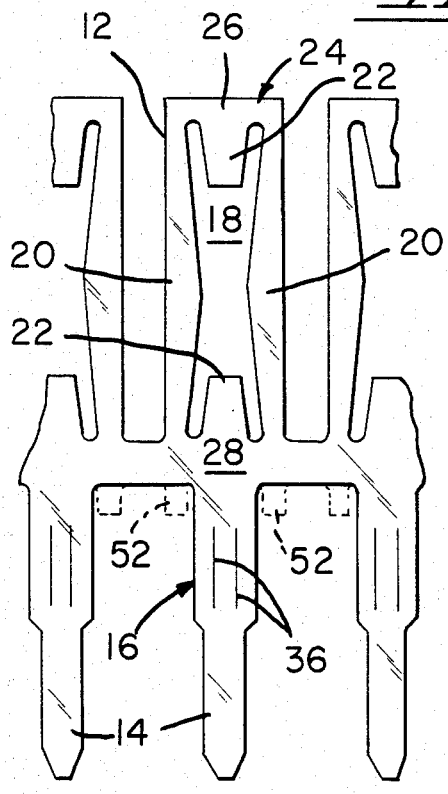
FIG. 7 is a view showing a stamped-out device of the present invention.

As noted above, the device is preferably stamped and formed. FIG. 7 is a drawing showing a strip of blanked-out devices prior to forming. Substantial economies are gained in making the devices of the present invention in this manner.

The present invention may be subject to many modifications and changes without departing from the spirit or essential characteristics thereof. The present embodiment is therefore intended in all respects as being illustrative and not restrictive of the scope of the invention.

We claim:

1. A method of making a device for stacking circuit boards, comprising the steps of:

a. providing an elongated strip of material and cutting out an opening adjacent a first end, defining thereby a pair of side members;

b. stamping out a leg at a second end with said leg being of less width than the width of the opening;

c. cutting a pair of longitudinal, parallel slits in the elongated strip intermediate the two ends to define three side by side parallel segments;

d. curving the first end around to near the slits so that the side members and opening define a receptacle for receiving a leg or the like therein; and e. forming a compliant member by bending the side by side segments outwardly with alternate segments being bent in opposite directions.

2. The method of claim 1 further including the step of providing a tab at each end of and projecting into the opening.

3. A product as made by the method of claim 1.

4. A product as made by the method of claim 2.

* * * * *